US010333258B2

(12) United States Patent
Zhao

(10) Patent No.: US 10,333,258 B2
(45) Date of Patent: Jun. 25, 2019

(54) ELECTRICAL CONNECTOR WITH SOLDERING LEGS EXTENDING FROM SHELL REAR EDGE AND RETAINED TO INNER EDGE OF PCB

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/846,233

(22) Filed: Dec. 19, 2017

(65) Prior Publication Data

US 2018/0175562 A1 Jun. 21, 2018

(30) Foreign Application Priority Data

Dec. 19, 2016 (CN) ..... 2016 1 1175179

(51) Int. Cl.

| | |
|---|---|
| ***H01R 12/72*** | (2011.01) |
| ***H01R 13/6581*** | (2011.01) |
| ***H01R 13/6591*** | (2011.01) |
| ***H01R 13/6593*** | (2011.01) |
| ***H01R 12/71*** | (2011.01) |

(Continued)

(52) U.S. Cl.

CPC ..... *H01R 13/6595* (2013.01); *H01R 12/716* (2013.01); *H01R 12/721* (2013.01); *H01R 12/727* (2013.01); *H01R 13/6581* (2013.01); *H01R 13/6591* (2013.01);

(Continued)

(58) Field of Classification Search

CPC ..... H01R 13/6581; H01R 13/6594; H01R 13/6595; H01R 12/72; H01R 12/721; H01R 12/55; H01R 12/57; H01R 12/58; H01R 12/716

See application file for complete search history.

(56) References Cited

U.S. PATENT DOCUMENTS 7,402,080 B2 * 7/2008 Xiao ..... H01R 13/658 439/607.2
7,922,535 B1 * 4/2011 Jiang ..... H01R 13/5205 439/271

(Continued)

FOREIGN PATENT DOCUMENTS

| | | |
|---|---|---|
| CN | 204947247 U | 1/2016 |
| CN | 105449415 A | 3/2016 |
| CN | 105449438 A | 3/2016 |

*Primary Examiner* — Vanessa Girardi

(74) *Attorney, Agent, or Firm* — Wei Te Chung; Ming Chieh Chang

(57) ABSTRACT

An electrical connector includes: a housing having a base and a tongue, the base having a mounting face; plural contacts arranged in the housing and exposed to the tongue, each contact having a contacting portion, a tail portion, and an intermediate portion between the contacting portion and the tail portion, the tail portions of the plural contacts being arranged in a front and rear rows at the mounting face of the housing base; and a shielding shell enclosing the housing and having a pair of rear mounting legs; wherein the shielding shell has a pair of soldering legs at two opposite outer sides of the front row of contact tail portions, respectively, forwardly and inwardly of the pair of rear mounting legs.

19 Claims, 10 Drawing Sheets

(51) Int. Cl.
*H01R 13/6595* (2011.01)
*H01R 12/57* (2011.01)
*H01R 24/60* (2011.01)

(52) U.S. Cl.
CPC ..... *H01R 13/6593* (2013.01); *H01R 12/57* (2013.01); *H01R 24/60* (2013.01)

(56) References Cited

U.S. PATENT DOCUMENTS

| | | | | |
|---|---|---|---|---|
| 7,997,932 | B2 * | 8/2011 | Xu | H01R 12/707 439/607.04 |
| 9,490,595 | B2 | 11/2016 | Little et al. | |
| 9,742,095 | B2 * | 8/2017 | Tsai | H01R 13/502 |

* cited by examiner

ELECTRICAL CONNECTOR WITH SOLDERING LEGS EXTENDING FROM SHELL REAR EDGE AND RETAINED TO INNER EDGE OF PCB

BACKGROUND OF THE INVENTION

1. Field of the Invention

The present invention relates to an electrical connector having a housing carrying a plurality of contacts and a shielding shell enclosing the housing, wherein the plurality of contacts include a front and rear rows of contact tail portions and the shielding shell includes a pair of soldering legs flanking the contact tail portions in the front row.

2. Description of Related Arts

U.S. Pat. No. 9,490,595 discloses an electrical connector including a metallic shell and a metallic bracket attached to a bottom of the shell, wherein the metallic shell has a pair of front mounting legs and the metallic bracket has a pair of rear mounting legs.

SUMMARY OF THE INVENTION

An electrical connector comprises: a housing having a base and a tongue, the base having a mounting face; a plurality of contacts arranged in the housing and exposed to the tongue, each contact having a contacting portion, a tail portion, and an intermediate portion between the contacting portion and the tail portion, the tail portions of the plurality of contacts being arranged in a front and rear rows at the mounting face of the housing base; and a shielding shell enclosing the housing and having a pair of rear mounting legs; wherein the shielding shell has a pair of soldering legs at two opposite outer sides of the front row of contact tail portions, respectively, forwardly and inwardly of the pair of rear mounting legs.

DETAILED DESCRIPTION OF THE PREFERRED EMBODIMENTS

Figure 1:
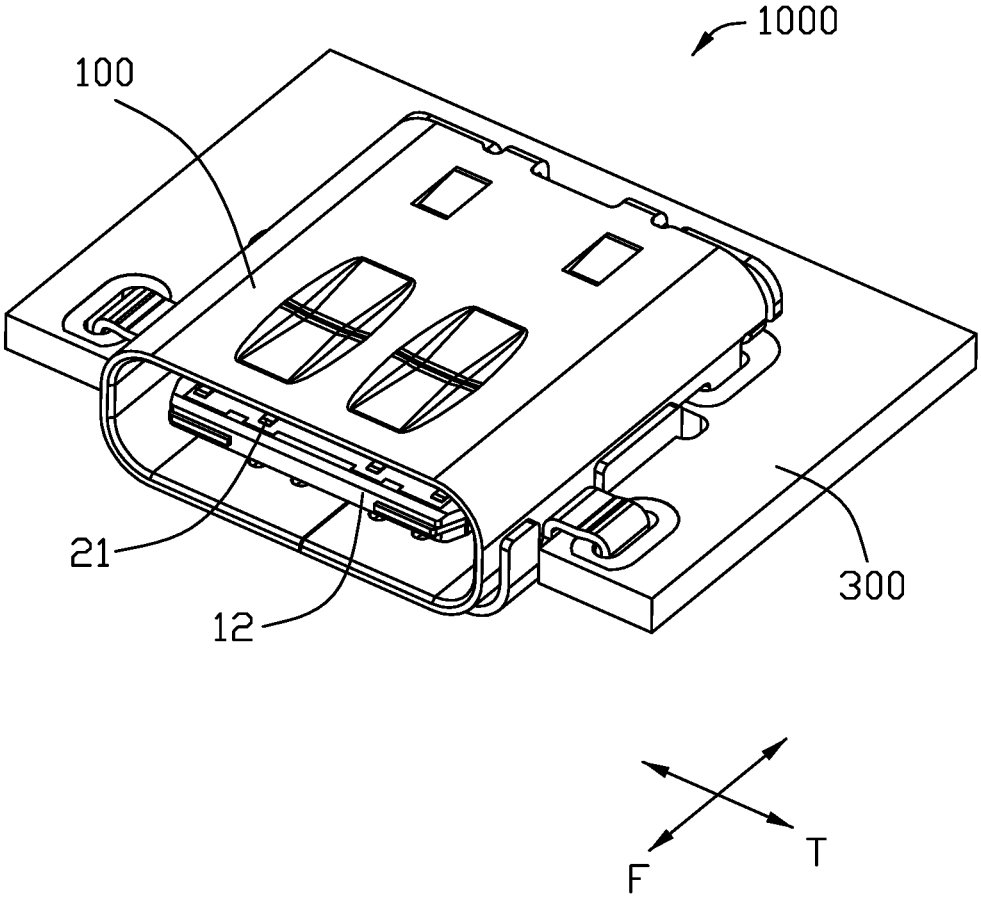
FIG. 1 is a front and top perspective view of an electrical connector in accordance with a first embodiment of the present invention mounted to a printed circuit board (PCB)

Referring to FIGS. 1-6, an electrical connector 1000 of a first embodiment, to be mounted on a printed circuit board (PCB) 300, comprises a housing 1, a plurality of contacts 2 arranged in the housing 1, and a shielding shell 4 enclosing the housing 1. The electrical connector 100 may further include a shielding plate 3 in the housing 1 and a sealing element 5 sealed at a rear of the housing 1. The PCB has an upper surface 301 and a notch 302. The notch 302 has an inner surface 3021 and two side surfaces 3022. The housing 1 has a base 11 and a tongue 12. The base 11 has a mounting face 110. Each contact 2 has a contacting portion 21, a tail portion 22, and an intermediate portion between the contacting portion 21 and the tail portion 22. The shielding shell 4 has a mating part 41 surrounding the housing tongue 12. The mating part 41 has a bottom surface 410.

Figure 4:
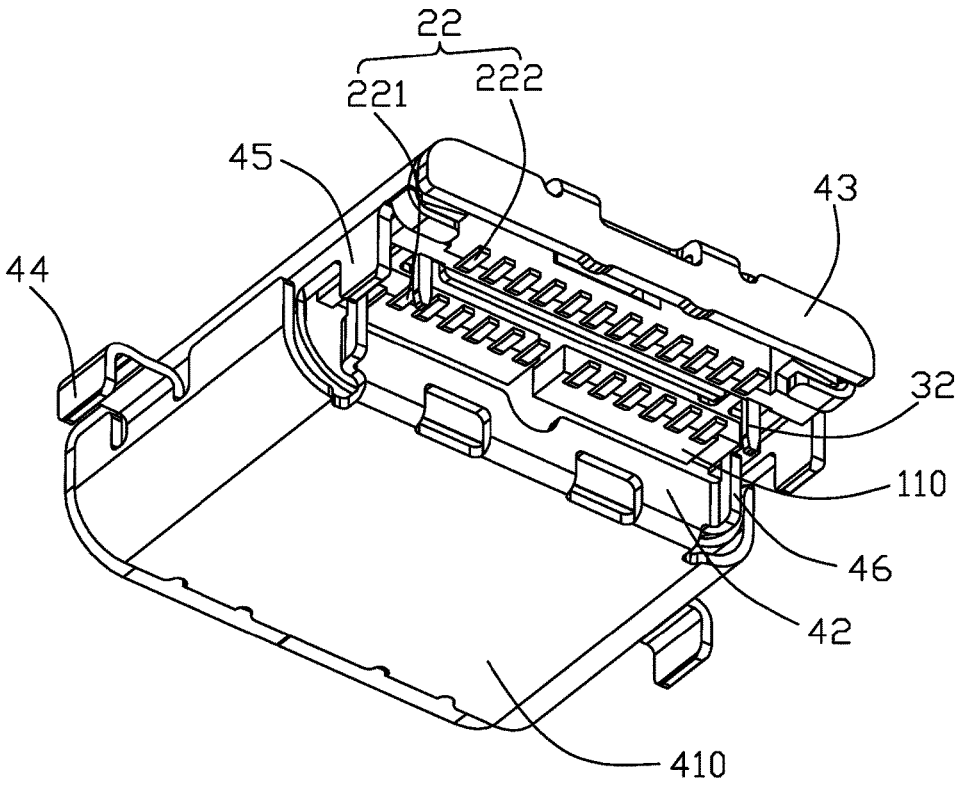
FIG. 4 is a bottom and rear perspective view of the electrical connector.
Figure 5:
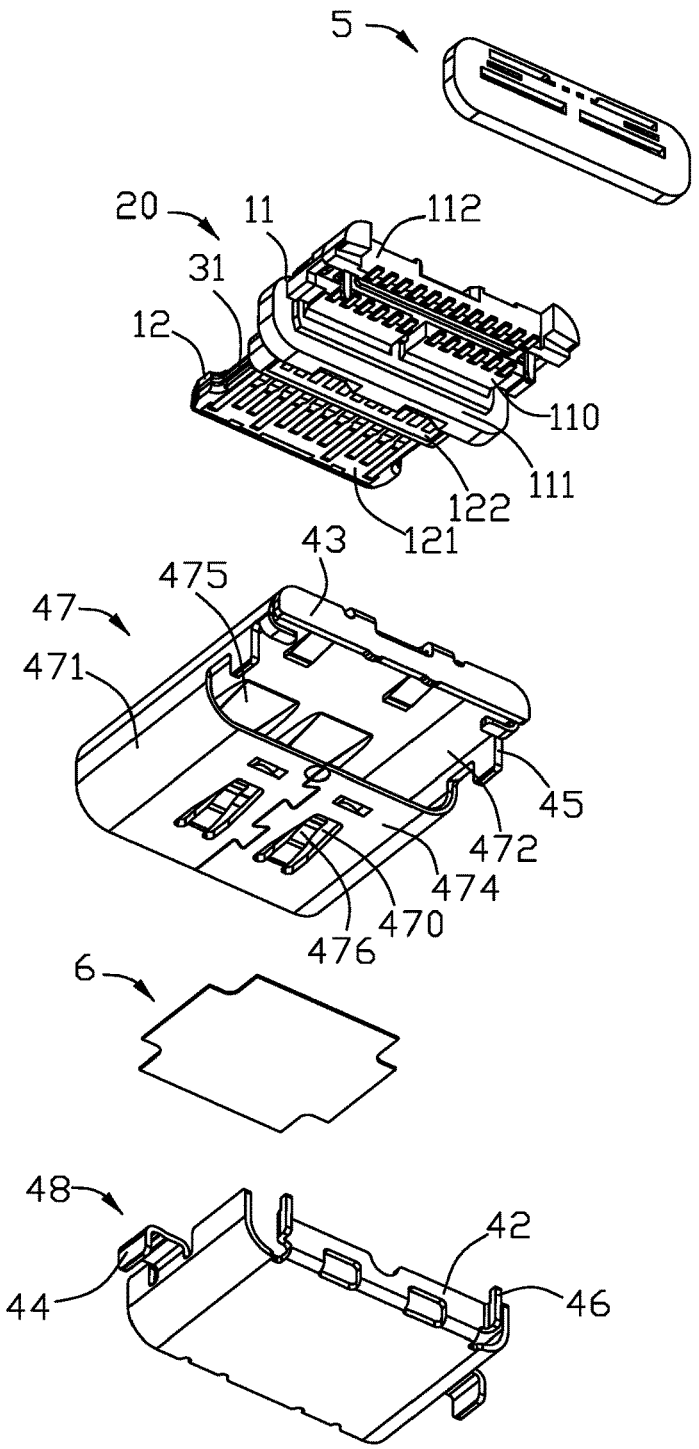
FIG. 5 is an exploded view of the electrical connector in FIG. 4.
Figure 6:
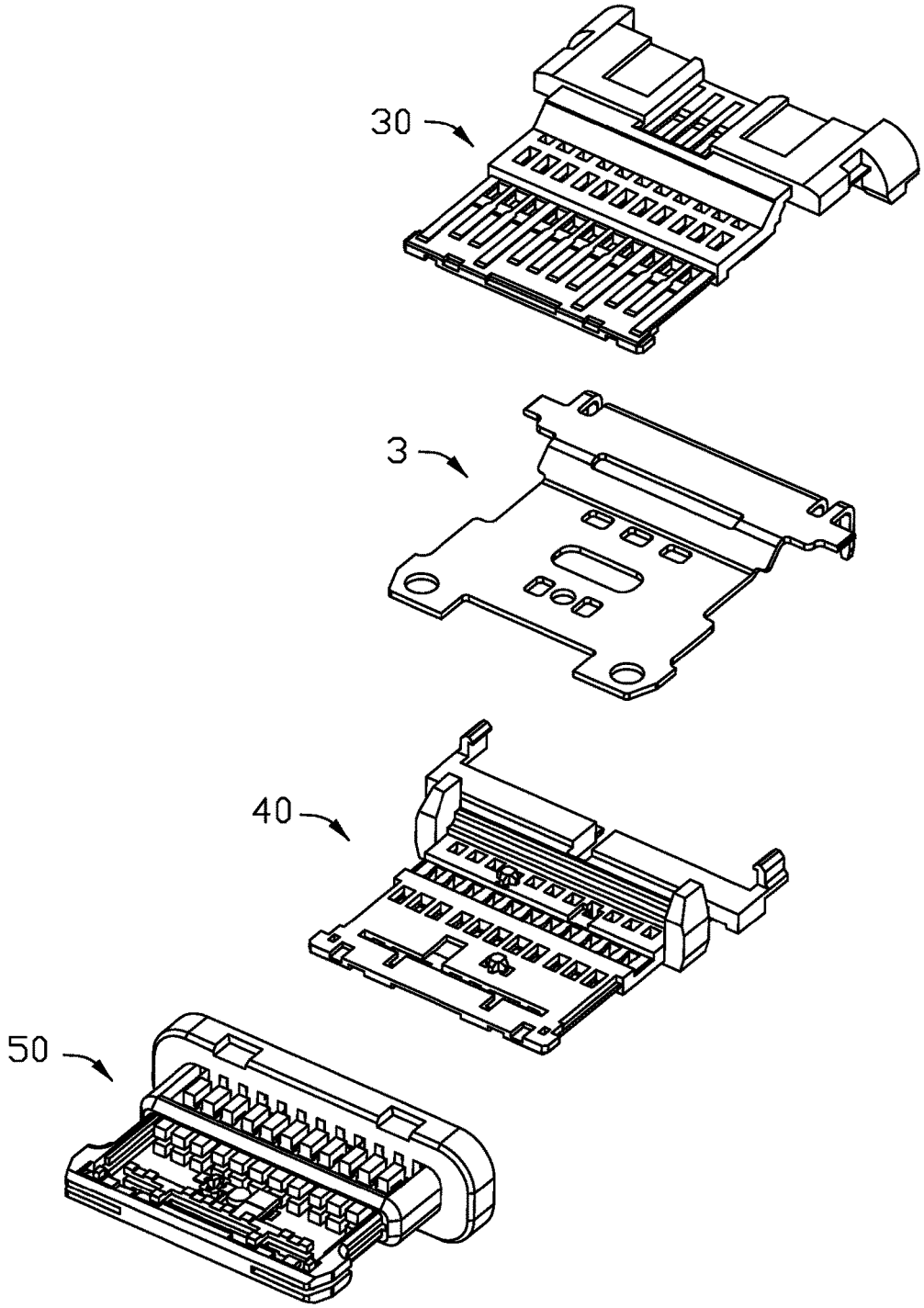
FIG. 6 is an exploded view of a contact module of the electrical connector.
Figure 7:
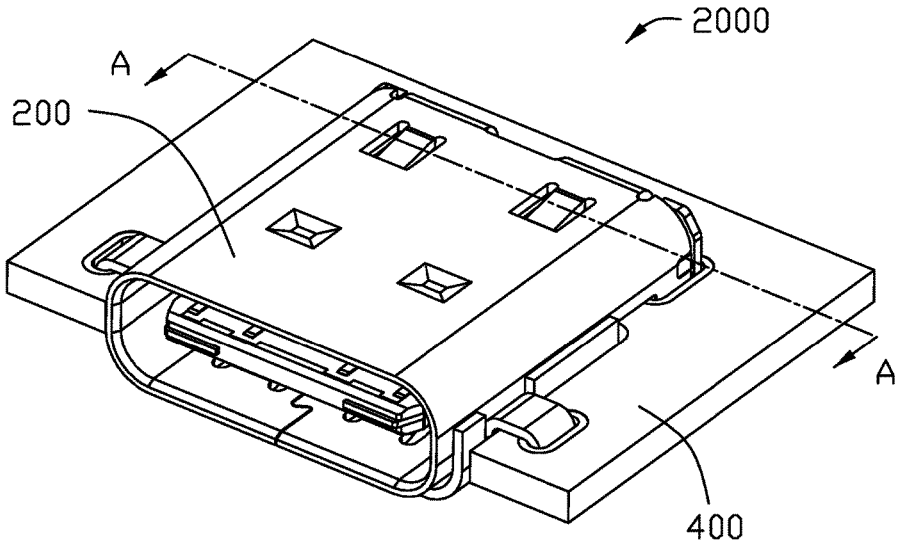
FIG. 7 is a front and top perspective view of an electrical connector in accordance with a second embodiment of the present invention mounted to a printed circuit board (PCB)
Figure 8:
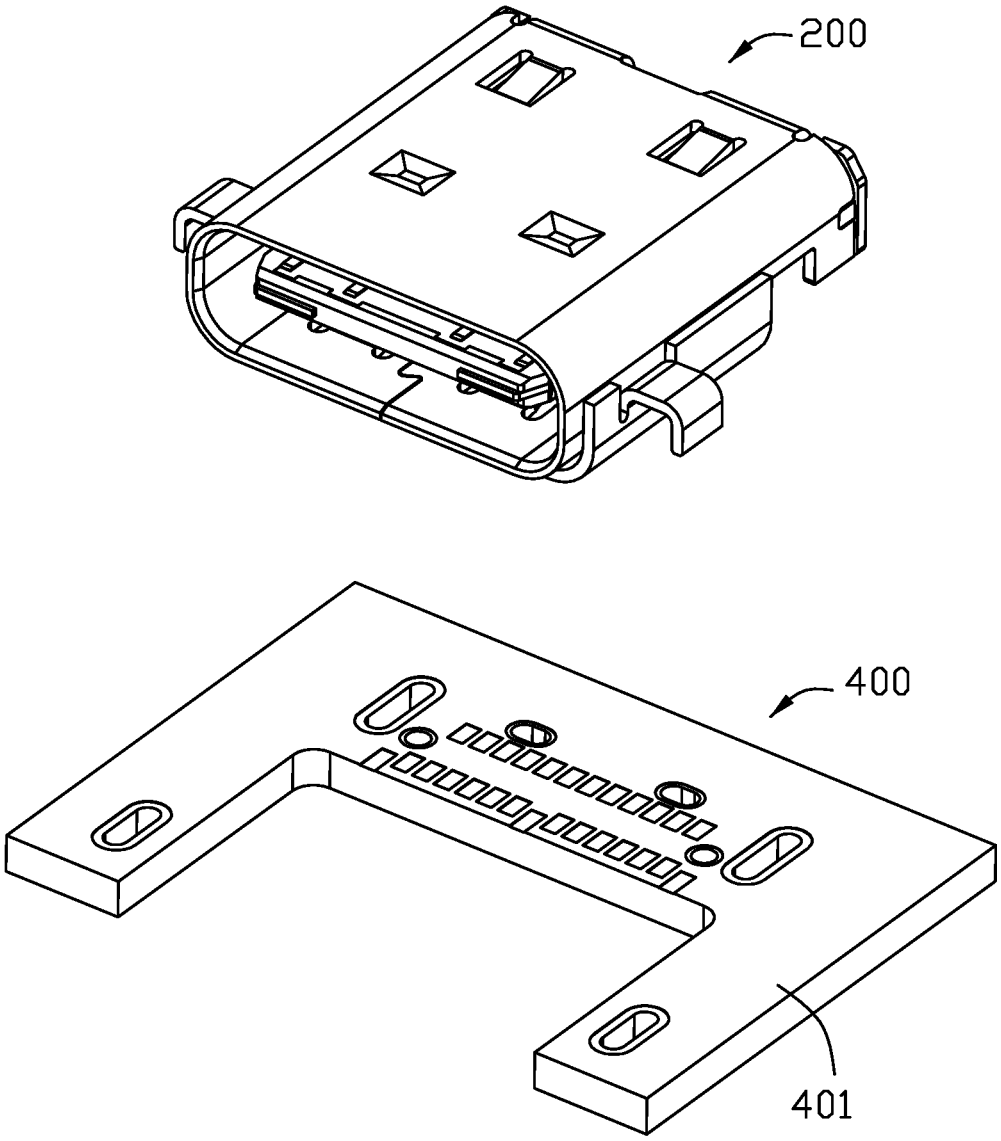
FIG. 8 is a view similar to FIG. 7 but showing the electrical connector in FIG. 7 not mounted to the PCB.
Figure 9:
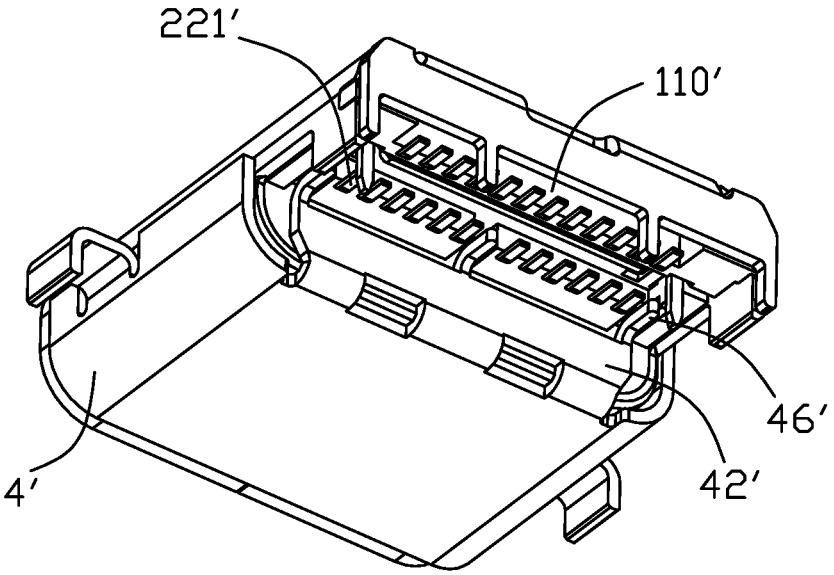
FIG. 9 is a bottom and rear perspective view of the electrical connector in FIG. 7.
Figure 10:
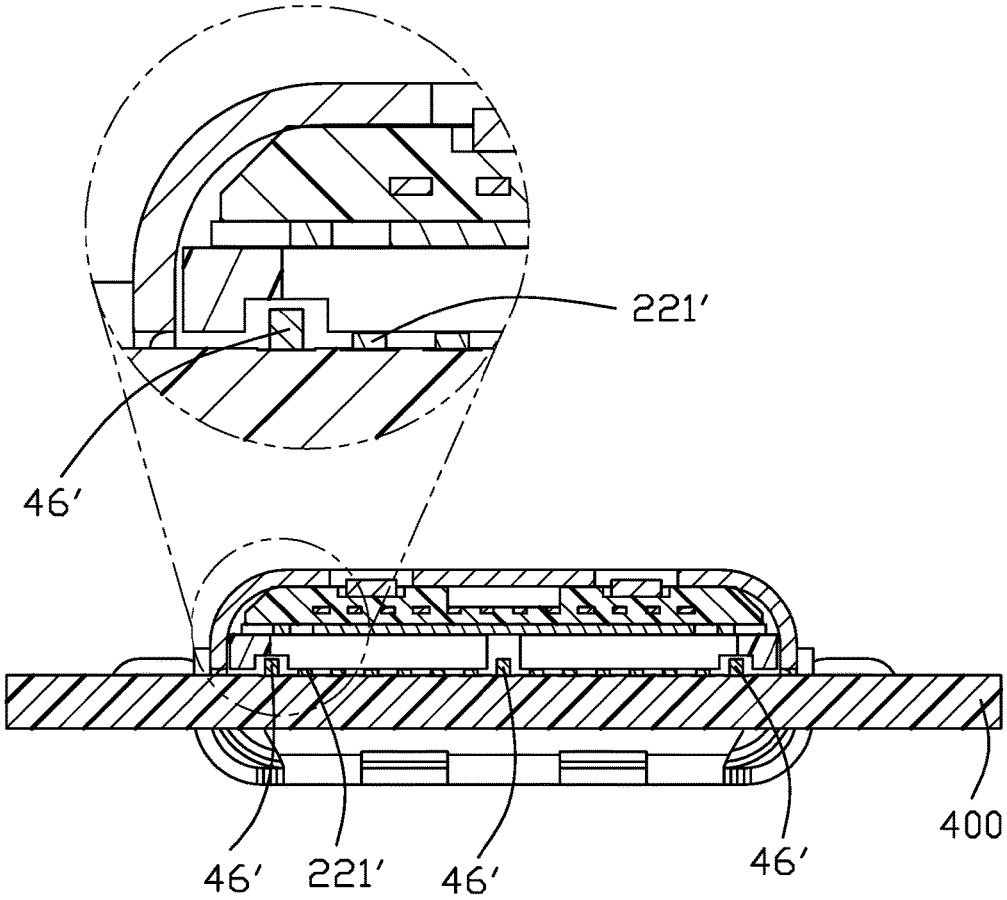
FIG. 10 is a cross-sectional view of the electrical connector in FIG. 7 taken along line A-A thereof.

Referring specifically to FIGS. 4-6, the housing 1 and the contacts 2, as well as the shielding plate 3 if present, constitute a contact module 20. The base 11 has a first rear face 111 under the mounting face 110 and a second rear face 112 over the mounting face 110. The tongue 12 has two opposite surfaces 121 and a platform 122. The tail portions 22 of the plurality of contacts 2 are arranged in a front row 221 and a rear row 222 at the mounting face 110 of the housing base 11. The shielding plate 3 may have notches 31 and legs 32. The contact module 20 may be constructed of an upper and lower units 30 and 40 sandwiching the shielding plate 3 and an over-molding insulator 50.

Figure 3:
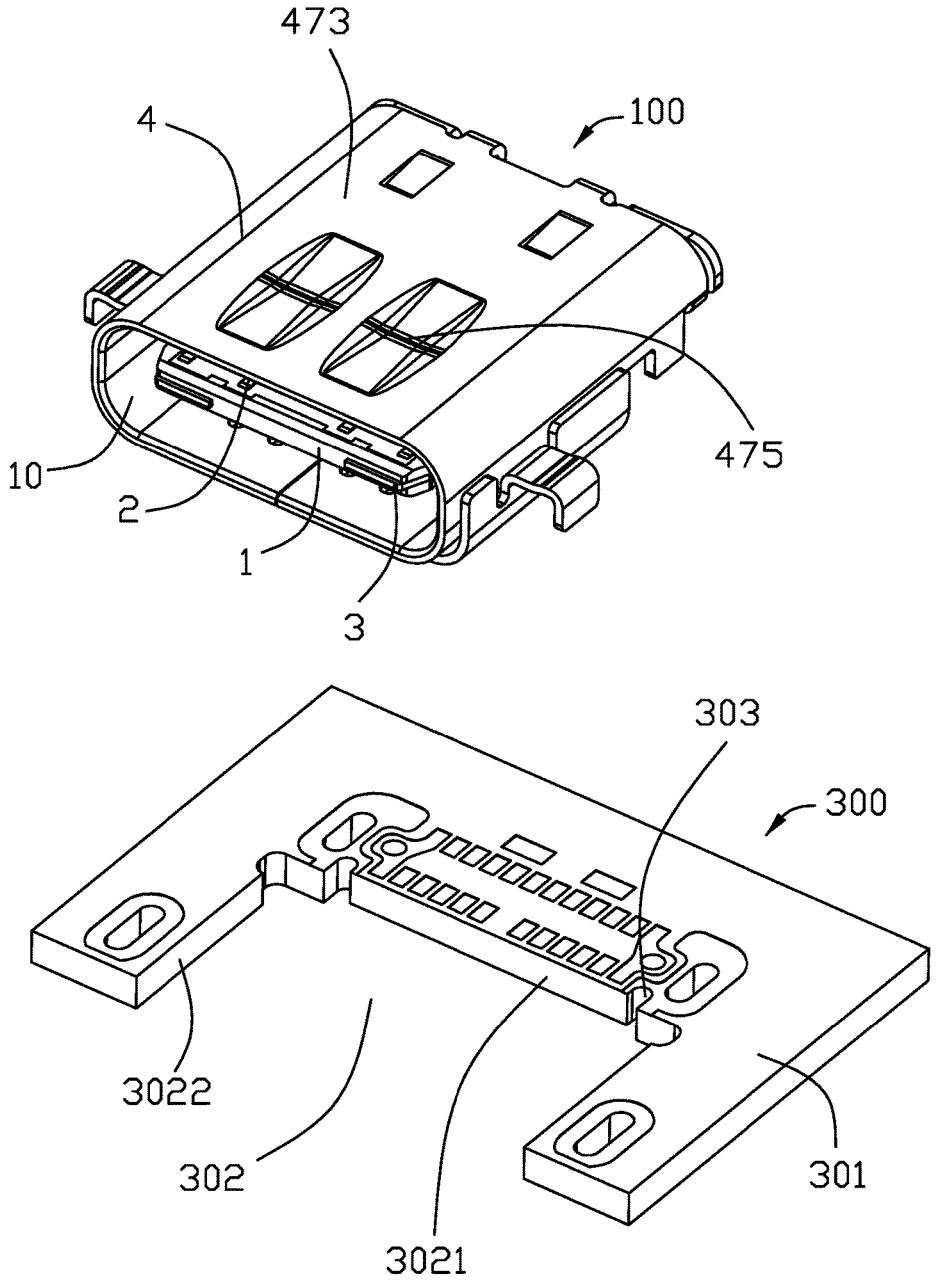
FIG. 3 is a view similar to FIG. 1 but showing the electrical connector not mounted to the PCB.

Referring in conjunction with FIG. 3, the shielding shell 4 encloses the housing tongue 12 to form a mating port 10. The shielding shell 4 has a first/lower rear cover 42 bent upward from the mating part 41 to cover the first rear face 111 and a second/upper rear cover 43 covering the second rear face 112. The shielding shell 4 has a pair of front mounting legs 44 and a pair of rear mounting legs 45. The shielding shell 4 has a pair of soldering legs 46 at the mounting face 110 of the housing base 11 for soldering to the PCB 300, which improves shielding effect. In this embodiment, the soldering legs 46 are bent from the first rear cover 42 and are located right under the mounting face 110. The pair of soldering legs 46 are arranged, respectively, at two opposite outer sides of the contact tail portions 22 in the front row 221 forwardly and inwardly of the pair of rear mounting legs 45.

Figure 2:
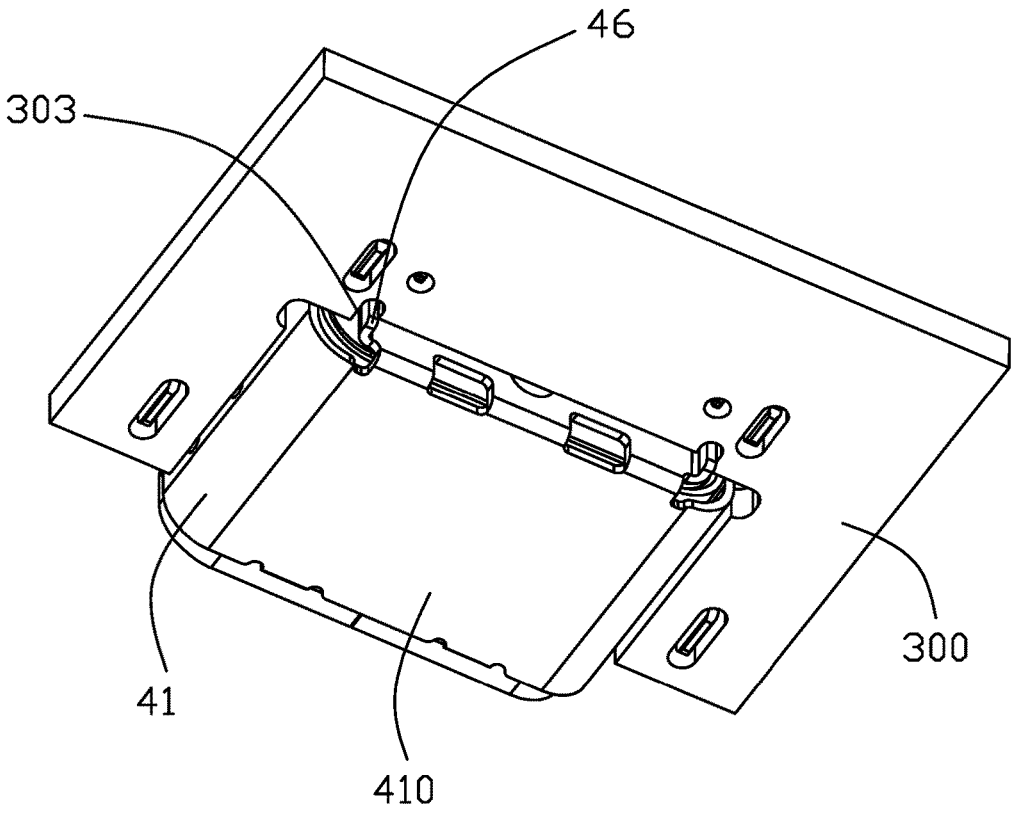
FIG. 2 is a bottom and rear perspective view of the electrical connector mounted to the PCB.

Referring specifically to FIGS. 2-4, the pair of soldering legs 46 of the shielding shell 4 are of a through hole type, i.e., inserting into grooves 303 of the PCB 300. The grooves 303 are conveniently formed at the inner surface/edge 3021 of the notch 302. The soldering legs 46 are bent rearward from the first rear cover 42 to become vertical. Such design of the grooves 303 and the legs 46 also simplifies mounting of the electrical connector 1000 to the PCB 300.

Referring specifically to FIGS. 1-3, the shielding shell 4 includes a main shell 47 and an auxiliary shell 48 attached to a bottom of the main shell 47. The main shell 47 has a surrounding part 471 enclosing the housing tongue 12 and a shielding part 472 at an upper of the housing base 11. The second rear cover 43 is bent downward from the shielding part 472. The surrounding part 471 has a top wall 473 and a bottom wall 474. The top wall 473 has bulges 475. The bottom wall 474 has openings 470 and spring tangs 476. The electrical connector 1000 may further have a sealing film 6 between the main shell 47 and the auxiliary shell 48. The main shell 47 includes the pair of rear mounting legs 45 and the second rear cover 43; the auxiliary shell 48 includes the pair of front mounting legs 44, the first rear cover 42, and the pair of soldering legs 46.

FIGS. 7-10 show an electrical connector 2000 of a second embodiment to be mounted to a PCB 400. Components of the electrical connector 2000 that are essentially same as those in the electrical connector 1000 will not be repeated here. Only the differences will be described as follows. Shielding shell 4' has three soldering legs 46' at mounting face 110' of the housing base for soldering to an upper surface 401 of the PCB 400 through SMT (surface mount technology). Contact tail portions in the front row 221' are arranged in two groups. Two of the three soldering legs 46' are arranged, respectively, at two opposite outer sides of contact tail portions in the front row 221' forwardly and inwardly of the pair of rear mounting legs while a middle one thereof is disposed between the two groups of contact tail portions.

What is claimed is:

1. An electrical connector comprising:

an insulative housing having a base and a tongue, the base having a mounting face;

a plurality of contacts arranged in the housing and exposed to the tongue, each contact having a contacting portion, a tail portion, and an intermediate portion between the contacting portion and the tail portion, the tail portions of the plurality of contacts being arranged in a front and rear rows at the mounting face of the housing base; wherein the front row of contact tail portions are arranged in two groups; and a shielding shell enclosing the housing and having a pair of rear mounting legs; wherein the shielding shell has a pair of soldering legs at two opposite outer sides of the front row of contact tail portions, respectively, forwardly and inwardly of the pair of rear mounting legs and the shielding shell has a third soldering leg between the two groups of contact tail portions; wherein the shielding shell also has a pair of front mounting legs.

2. The electrical connector as claimed in claim 1, wherein the pair of soldering legs of the shielding shell are of a surface mount type.

3. The electrical connector as claimed in claim 1, wherein the pair of soldering legs of the shielding shell are of a through hole type.

4. The electrical connector as claimed in claim 1, wherein the shielding shell includes a main shell and an auxiliary shell attached to a bottom of the main shell, the auxiliary shell having a rear cover, and the pair of soldering legs are bent from the rear cover.

5. An electrical connector assembly comprising:

an electrical connector including:

a contact module including an insulative housing and a plurality of contacts retained to the housing, each of said contact including a front contacting portion and a rear tail portion exposed outside of the housing along a front-to-back direction; and a metallic shielding shell including a main shell directly enclosing the contact module and defining a mating cavity, and an auxiliary shell attached upon the main shell; wherein the auxiliary shell includes a pair of front mounting legs by two sides of the mating cavity in a transverse direction perpendicular to said front-to-back direction, and a pair of soldering legs behind the mating cavity in said front-to-back direction; wherein the main shell includes a pair of rear mounting legs at a rear end, and the soldering legs of the auxiliary shell are located between the pair of rear mounting legs of the main shell in the transverse direction, viewed in the front-to-back direction.

6. The electrical connector assembly as claimed in claim 5, wherein said pair of soldering legs are located by two sides of tails of the contacts in the transverse direction.

7. The electrical connector assembly as claimed in claim 5, wherein the auxiliary shell includes a vertical rear cover, and the pair of the soldering legs extend rearwardly from two opposite ends of the vertical rear cover along the front-to-back direction.

8. The electrical connector assembly as claimed in claim 5, wherein each of said soldering legs extends in either a horizontal plane or a vertical plane.

9. The electrical connector assembly as claimed in claim 5, further including a printed circuit board defining a notch in a front edge thereof, wherein the mating cavity of the electrical connector is located within the notch, and the pair of soldering legs are received within a pair of corresponding grooves formed in an inner edge of the printed circuit board and communicating with the notch in the front-to-back direction.

10. The electrical connector assembly as claimed in claim 5, further including a printed circuit board defining a notch in a front edge thereof, wherein the mating cavity of the electrical connector is located within the notch, and the pair of soldering legs extending from a vertical rear cover of the auxiliary shell, are surface-mounted upon an upper surface of the printed circuit board behind the notch.

11. The electrical connector assembly as claimed in claim 10, wherein said main shell further includes another vertical rear cover, and the tails of the contacts are located between the rear cover of the main shell and the rear cover of the auxiliary shell in the front-to-back direction.

12. An electrical connector assembly comprising:

an electrical connector including;

a contact module including an insulative housing and a plurality of contacts retained to the housing, each of said contact including a front contacting portion and a rear tail portion exposed outside of the housing along a front-to-back direction; and a metallic shielding shell including a main shell directly enclosing the contact module and defining a mating cavity, and an auxiliary shell attached upon the main shell; wherein the main shell includes an upper vertical rear cover shielding an upper part of a rear side of the housing in said front-to-back direction, the auxiliary shell include a lower vertical rear cover shielding a lower part of the rear side of the housing in said front-to-back direction, said upper vertical rear cover and said lower vertical rear cover are offset from each other in said front-to-back direction, and all tails of the contacts are located between the upper vertical rear cover and the lower vertical rear cover in said front-to-back direction.

13. The electrical connector assembly as claimed in claim 12, wherein viewed in the front-to-back direction from the rear side, the tails of the contacts are located between the upper vertical rear cover and the lower vertical rear cover in a vertical direction perpendicular to the front-to-back direction.

14. The electrical connector assembly as claimed in claim 12, wherein said auxiliary shell includes a pair of soldering legs behind the mating cavity, and the tails of the contacts are located between said pair of soldering legs in a transverse direction perpendicular to the front-to-back direction.

15. The electrical connector as claimed in claim 14, further including a printed circuit board defining a notch in a front edge thereof, wherein the mating cavity of the electrical connector is located within the notch, and the pair of soldering legs are received within a pair of corresponding grooves formed in an inner edge of the printed circuit board and communicating with the notch in the front-to-back direction.

16. The electrical connector assembly as claimed in claim 14, further including a printed circuit board defining a notch in a front edge thereof, wherein the mating cavity of the electrical connector is located within the notch, and the pair of soldering legs extending from said lower vertical rear cover of the auxiliary shell, are surface-mounted upon an upper surface of the printed circuit board behind the notch.

17. The electrical connector assembly as claimed in claim 14, wherein said main shell further includes a pair of rear mounting legs behind the pair of soldering legs in the front-to-back direction.

18. The electrical connector assembly claimed in claim 17, wherein said main shell further includes a pair of front mounting legs by two sides of the mating cavity in the transverse direction, and the pair of soldering legs are located between the pair of front mounting legs and the pair of rear mounting legs in the front-to-back direction.

19. An electrical connector assembly comprising:

an electrical connector including:

a contact module including an insulative housing and a plurality of contacts retained to the housing, each of said contact including a front contacting portion and a rear tail portion exposed outside of the housing along a front-to-back direction; and a metallic shielding shell including a main shell directly enclosing the contact module and defining a mating cavity, and an auxiliary shell attached upon the main shell; wherein the auxiliary shell includes a pair of front mounting legs by two sides of the mating cavity in a transverse direction perpendicular to said front-to-back direction, and a pair of soldering legs behind the mating cavity in said front-to-back direction, further including a printed circuit board defining a notch in a front edge thereof, wherein the mating cavity of the electrical connector is located within the notch, and the pair of soldering legs extending from a vertical rear cover of the auxiliary shell, are surface-mounted upon an upper surface of the printed circuit board behind the notch.

* * * * *